US005556163A

United States Patent [19]

Rogers, III et al.

[11] Patent Number: 5,556,163

[45] Date of Patent: Sep. 17, 1996

[54] AUTOMATICALLY ADJUSTABLE OFFICE AND TASK CHAIRS

[75] Inventors: M. Weldon Rogers, III, St. Louis, Mo.; Bruce E. Bogart, Greenville, Ind.; David L. Gerke, Blytheville, Ark.; Robert A. Eberle, Kansas City, Mo.; Craig Thomas, Osceola, Ark.

[73] Assignee: EAC Corporation, St. Louis, Mo.

[21] Appl. No.: 272,923

[22] Filed: Aug. 17, 1994

[51] Int. Cl.[6] ..... A47C 3/40

[52] U.S. Cl. ..... 297/330; 297/362.11; 297/337; 297/344.2

[58] Field of Search ..... 297/330, 316, 297/320, 344.2, 337, 362.11, 353

[56] References Cited

U.S. PATENT DOCUMENTS

| | | | |
|---|---|---|---|
| 2,310,346 | 2/1943 | Bell | 297/337 X |
| 2,886,096 | 5/1959 | Eckart et al. | 297/353 X |
| 3,147,038 | 9/1964 | Barabas | 297/353 X |
| 3,232,574 | 2/1966 | Ferro | 248/379 |
| 3,232,575 | 2/1966 | Ferro | 248/430 |
| 3,486,417 | 12/1969 | Di Vita et al. | 91/216 |
| 3,554,598 | 1/1971 | Dunkin | 297/330 |
| 3,765,720 | 10/1973 | Sakai | 297/330 |
| 3,866,973 | 2/1975 | Heubeck | 297/316 |
| 3,964,786 | 6/1976 | Mashuda | 297/330 |
| 3,984,146 | 10/1976 | Krestel et al. | 297/330 |
| 4,101,168 | 7/1978 | Ferro | 297/329 |
| 4,333,683 | 6/1982 | Ambasz | 297/337 X |
| 4,344,594 | 8/1982 | Hirth | 248/421 |
| 4,516,805 | 5/1985 | Leeper et al. | 297/330 |
| 4,552,404 | 11/1985 | Congleton | 297/330 |
| 4,743,065 | 5/1988 | Meiller et al. | 297/316 X |
| 4,944,554 | 7/1990 | Gross et al. | 297/330 X |
| 4,966,413 | 10/1990 | Palarski | 297/330 |
| 4,993,777 | 2/1991 | LaPointe | 297/325 |
| 5,035,466 | 7/1991 | Mathews et al. | 297/337 |
| 5,203,609 | 4/1993 | Stoeckl | 297/330 X |
| 5,251,961 | 10/1993 | Pass | 297/423.1 |

FOREIGN PATENT DOCUMENTS

| | | | |
|---|---|---|---|
| 982564 | 1/1951 | France | 297/330 |
| 3222832 | 12/1983 | Germany | 297/330 |
| 37550 | 2/1986 | Japan | 297/330 |
| 249844 | 11/1986 | Japan | 297/337 |
| 2153218 | 8/1985 | United Kingdom | 297/330 |

*Primary Examiner*—Peter M. Cuomo
*Assistant Examiner*—David E. Allred
*Attorney, Agent, or Firm*—Armstrong, Teasdale, Schlafly & Davis

[57] ABSTRACT

A cordless, power-adjustable office or task chair comprising: a seat height adjustment mechanism, including an electric motor, the upper and lower members of the adjustable column relative to each other to raise and lower the height of the seat. A seat tilt adjustment mechanism, including an electric motor, moves the top plate relative to the bottom plate to adjust the angle of tilt of the seat. A seat position adjustment mechanism, including an electric motor, moves the seat relative to the top plate. A back tilt adjustment mechanism, including an electric motor, moves the back support strap to tilt the chair back forwardly and rearwardly. A back height adjustment mechanism, including an electric motor, moves the back axially with respect to the back support strap. A seat height switch controls the seat height adjustment mechanism. A seat tilt switch controls the seat tilt adjustment mechanism. A seat position switch controls the seat position adjustment mechanism. A back tilt switch controls the back tilt adjustment mechanism. A back height switch controls the back height adjustment mechanism. Each of the switches is positioned so as to be operable by a user seated on the chair.

13 Claims, 8 Drawing Sheets

AUTOMATICALLY ADJUSTABLE OFFICE AND TASK CHAIRS

BACKGROUND OF THE INVENTION

This invention relates to office and task chairs, and more particularly to a cordless electrically-powered adjustable office or task chair that permits multiple power-assisted position adjustments.

Office chairs and more particularly task chairs are often purchased with the user and intended use of the chair in mind. Depending on the application one or more adjustments, at the option of the purchaser, can be provided. This invention provides cordless electric powered adjustments in combinations determined by the purchaser. At the option of the purchaser the chair may be equipped with a single cordless-electrically powered device with the remaining adjustments manual, or combinations of the same, for a fully cordless-electrically powered chair.

Office chairs are chairs used by workers seated at desks and consoles, and task chairs include chairs used in a wide variety of applications where the worker is required to remain seated for long durations to perform their required duties. Because of the length of time that many workers spend seated, it is important that office chairs and task chairs be properly adjusted for each user to provide enhanced comfort. It is also important that workers avoid sitting in the exact same position for extended periods.

To improve the comfort of office and task chairs, provision is usually made for some adjustments to accommodate the physical size of the user. These adjustments usually include an adjustment of the height of the seat relative to the base. Other adjustments that are less frequently provided are adjustment of the chair back height, adjustment of the chair back angle, adjustment of the seat angle, and adjustment of the seat depth. In conventional office and task chairs, the adjustments must be made manually. Often, the adjustments cannot be made while the user is seated. For example, to raise the seat height or change the seat angle, the user usually muse shift or remove his or her weight from the seat. The controls for many of the manual adjustments often cannot be conveniently reached while seated. Moreover, many of the conventional controls are counter-intuitive, for example, on many chairs the user must raise a lever to lower the seat. Thus, chair adjustments can be tedious and time consuming as the user repeatedly adjusts the chair and tests it, and users frequently give up before the chair is properly adjusted, or simply don't even bother to try to adjust the chair and use it as they find it. This is particularly true where more than one person uses the chair such as multi-shift operations, such as in police stations and hospitals. Using a chair at an improper height increases the discomfort and fatigue of the user, reducing productivity.

It is important that workers avoid sitting in the exact same position for extended periods, even in a properly adjusted chair. Thus, periodically changing the chair position, even slightly, can improve the comfort of even a properly adjusted chair, reducing strain on the lower torso and back. However, because of the difficulty of making adjustments in conventional office and task chairs, few, if any, users bother to make periodic adjustments of the chair during the day.

SUMMARY OF THE INVENTION

An office or task chair constructed according to the principles of this invention is capable of providing up to five or more electrically-powered position adjustments without connection to an external power source, and without requiring the user to leave the chair. The chair can provide precise positional adjustment, and because the user can adjust the height while comfortably seated in the chair, the user can quickly and easily adjust the chair to the proper position, without repeatedly adjusting and testing the position. The user can also quickly, easily and comfortably make minor adjustments to seating positions during the day to improve comfort, and reduce strain from sitting in exactly the same position for extended periods of time, and reduce repetitive motion injuries.

With the precise positional adjustment provided by the invention, it is also possible to incorporate a memory device into the chair to store one or more chair position settings, so that a number of different users can quickly adjust the chair to their preselected positions. With the precise positional adjustment provided by this invention, it is even possible to incorporate a memory device programmable to automatically make minor adjustments to the chair positions at time intervals, either randomly or at preselected intervals, thus providing enhanced seating comfort and reduced strain on the body.

The chair includes a replaceable and/or rechargeable power source such as a battery, to power the adjustment mechanisms without connection to an external power source. Thus, the chair can be operated and used without hinderance from an external power source connection. Other sources of cordless power, such as solar cells, could also be employed.

The chair provides power-assisted adjustment of the position, allowing the user to remain comfortably seated while adjusting the position. The chair makes it easier for the user to adjust the position, and thus makes it more likely that the user will adjust the chair to the proper position. Thus, the chair has the effect of reducing user discomfort and fatigue. The principles of this invention can be incorporated in newly manufactured chairs, or may be retrofitted to existing chairs.

These and other features and advantages will be in part apparent and in part pointed out hereinafter.

BRIEF DESCRIPTION OF THE DRAWINGS

Corresponding reference numerals indicate corresponding parts in the drawings.

DETAILED DESCRIPTION OF THE PREFERRED EMBODIMENTS

Figure 1:
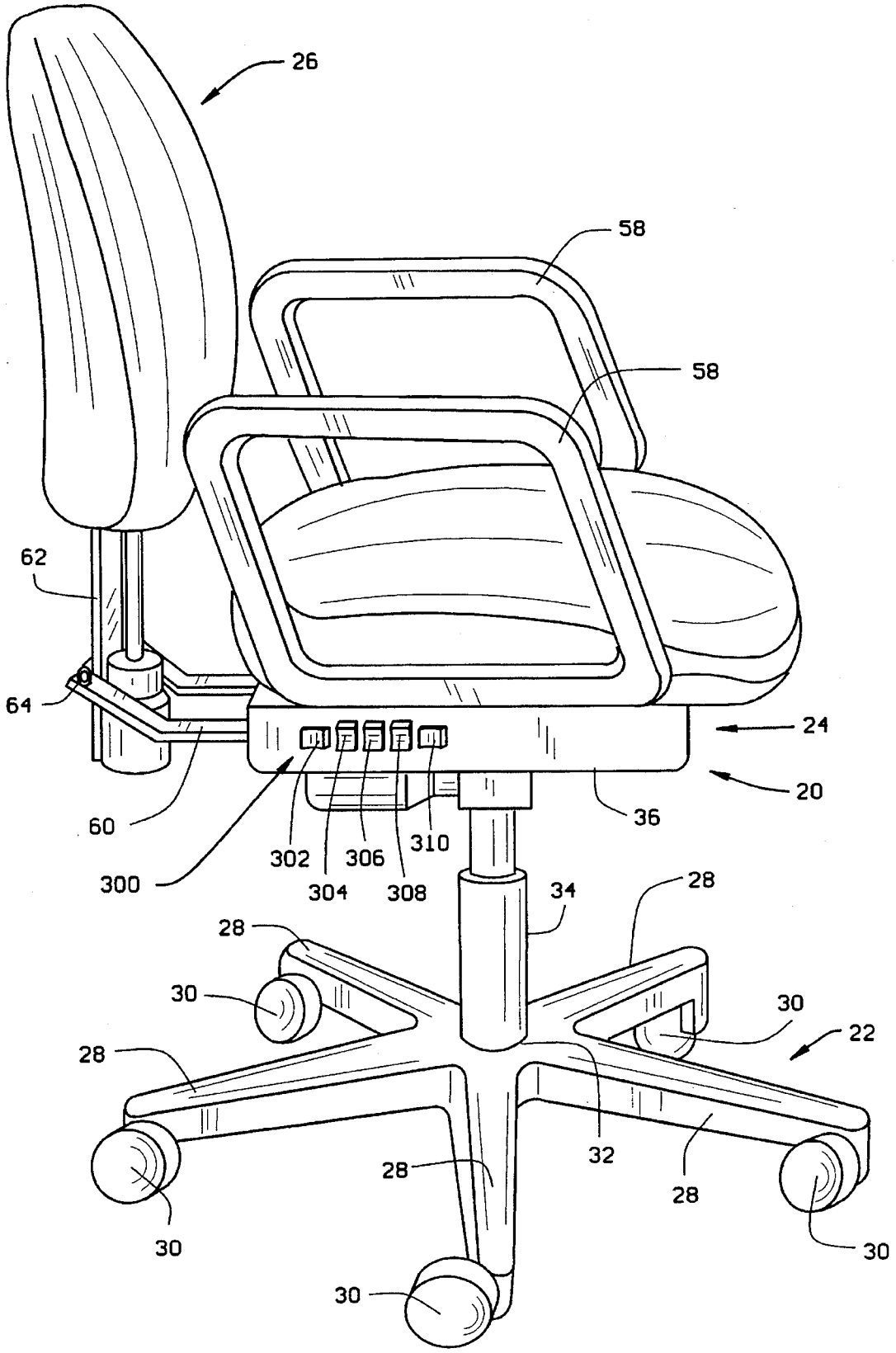
FIG. 1 is a perspective view of a task chair constructed according to the principles of this invention.
Figure 2:
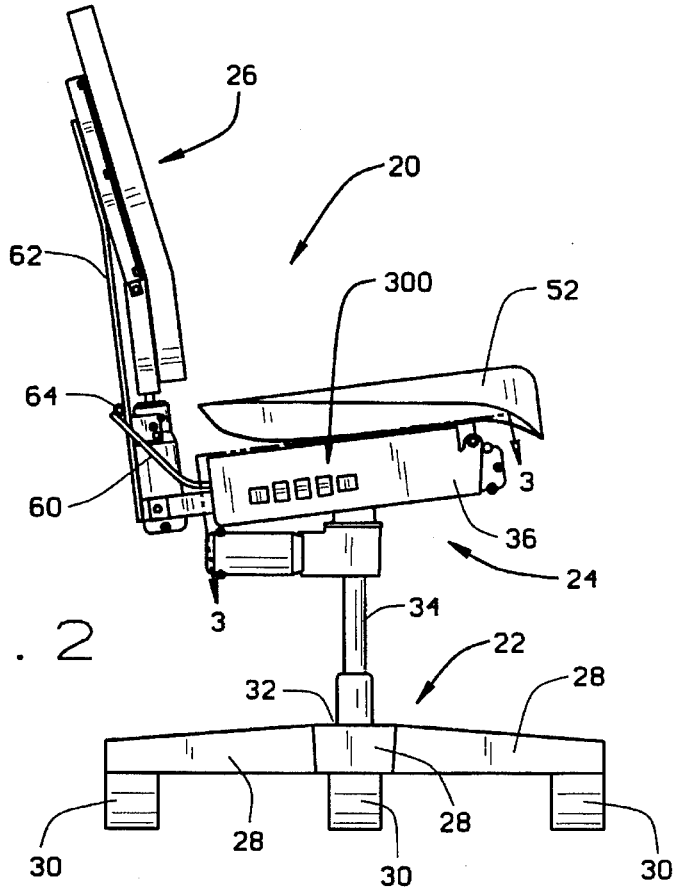
FIG. 2 is a side elevation view of the task chair.

A task chair constructed according to the principles of this invention is indicated generally as 20 in FIGS. 1 and 2. Generally, the task chair 20 comprises a chair base 22, a chair seat assembly 24 supported on the chair base, and a chair back 26 supported at the rear of the chair seat. The chair back 26 can include a vertically and/or horizontally adjustable lumbar support.

The chair base 22 is preferably a conventional star-shaped chair base with four, five, or six legs 28 (five legs are shown in FIG. 1), each leg having a caster 30 so that the chair base freely rolls on the floor. Alternatively, some bases may be equipped with glides (not shown) to keep the chair on a fixed path. The chair base 22 also includes a mounting fixture 32 for receiving an adjustable column 34 that supports the chair seat assembly 24.

Figure 3:
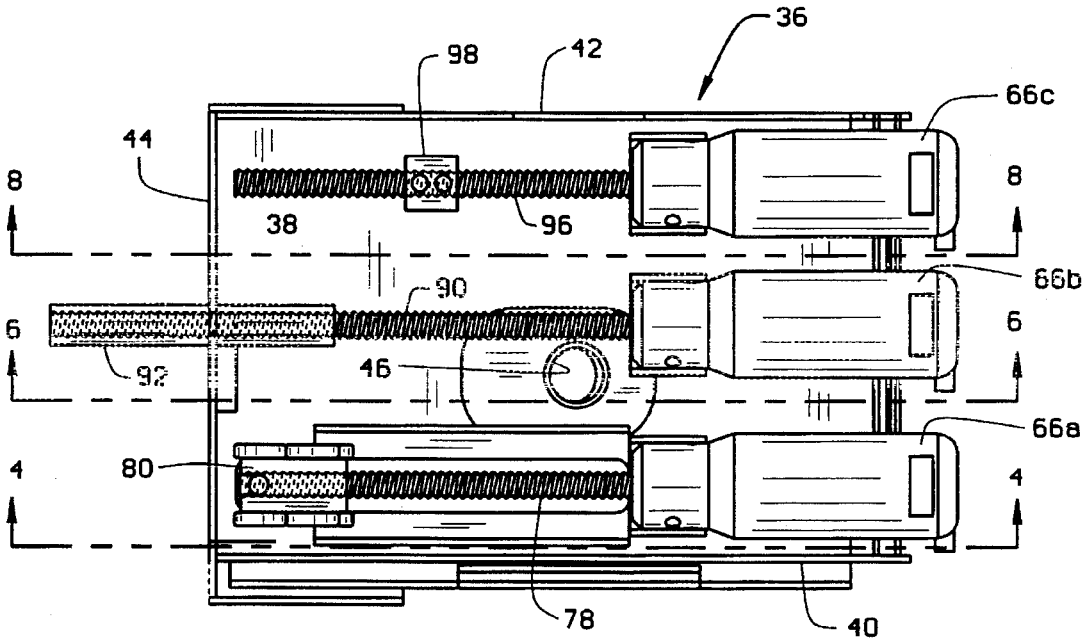
FIG. 3 is a horizontal cross-sectional view of the task chair taken along the plane of line 3—3 in FIG. 2.
Figure 18:
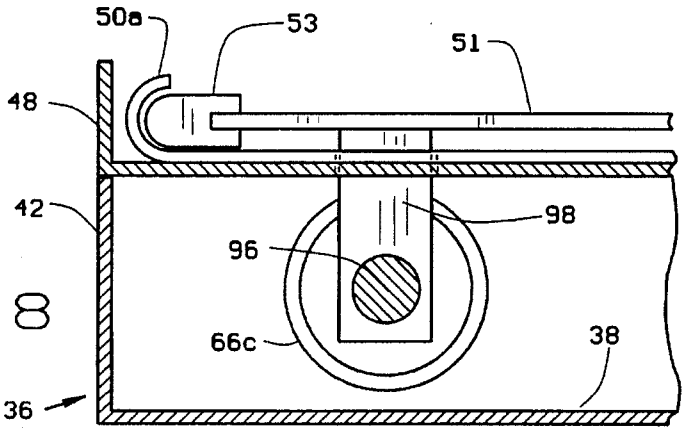
FIG. 18 is a partial vertical cross-sectional view taken along the plane of line 18—18 in FIG. 9, showing the seat depth adjustment mechanism.

The seat assembly 24 includes box 36, best shown in FIG. 3, having at least a bottom 38, and left, right, and rear sides 42, 40, and 44, respectively, and an open top. There is a mounting bracket 46, including a tapering socket, within the bottom 38 of the box 36 for mounting the seat assembly 24 on the adjustable column 34. A lid 48 is hingedly mounted at the front end of the box 36 along a horizontal axis. A track 50, comprising opposed U-shaped track members **50*a* (only one is shown in FIG. 18), is mounted on the lid 48, and a seat 52 is slidably mounted on the track for forward and rearward movement relative to the lid. The support 51 mounted on the underside of the seat 52 has pairs of sliders 53 thereon for sliding in the track 50. Armrests 58 (shown only in FIG. 1) can be provided on each side of the seat 52. Of course, some other type of armrest could be employed on the chair, if desired, and optionally mounted to the seat 52, or the box 36**.

A chair back mounting bracket 60 extends generally rearwardly and upwardly from the back of lid 48. A back support strap 62 is pivotally mounted to bracket 60 with hinge 64 to pivot forwardly and rearwardly about a generally horizontal axis. This axis is preferably at about the same vertical height as the back of the seat 52. Because the back support strap 62 is supported by the lid 48 via bracket 60, the seat 52 and the chair back 26 move together as lid 48 moves. The chair back 26 is slidably mounted on the support strap 62, as described in more detail below.

According to the principles of this invention, the task chair 20 includes up to five or more power-assisted position adjustment mechanisms. There can be an adjustment of the angle of the tilt of the seat; the angle of the tilt of the chair back with respect to the seat; the depth of the seat relative to the chair back; the height of the back relative to the seat; and the height of the seat relative to the base. In this preferred embodiment, separate adjustment mechanisms are provided for each of these five adjustments. Each mechanism is driven by motorized actuator 66, comprising a casing 68 containing a cordless electric motor 70 having a motor shaft 72 that is connected to a transmission 74 which has a drive shaft 76. (See FIG. 16) The electric motor 70 can be a conventional reversible battery-powered electric motor, for example of the type used in electric power tools. Since each mechanism is independently driven, each function can be considered to be mutually exclusive, thus allowing the purchaser and manufacturer to customize the choice of adjustments available.

Figure 4:
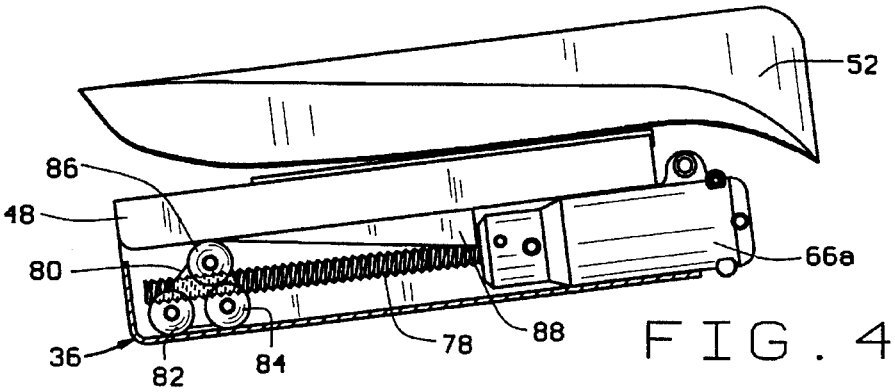
FIG. 4 is a partial vertical cross-sectional view of the task chair, taken along the plane of line 4—4 in FIG. 3, showing the seat-tilt adjustment mechanism with the seat in its rearmost tilted position.
Figure 5:
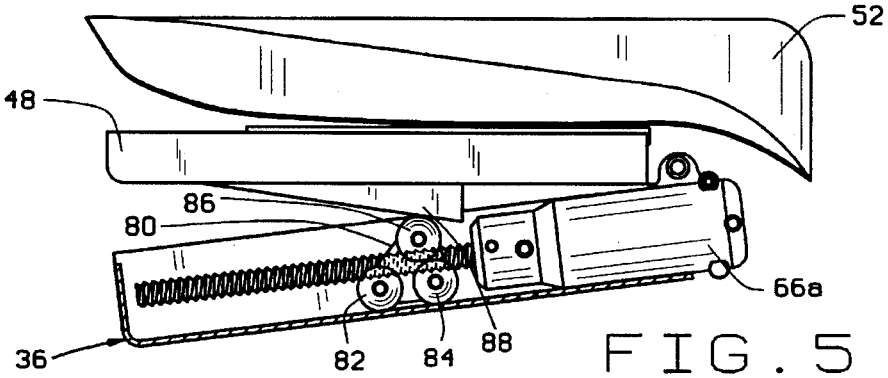
FIG. 5 is a partial vertical cross-sectional view of the task chair, similar to FIG. 4, except that the seat is in its forwardmost tilted position.

The seat tilt adjustment mechanism is best shown in FIGS. 4 and 5. The seat tilt adjustment mechanism comprises an actuator **66*a* in the box 36 having a screw 78 on the drive shaft of the actuator. The screw 78 extends through a wheeled cart 80, such that rotation of the screw causes the cart to translate forwardly and rearwardly in the box 36, depending upon the direction of rotation of the screw. The bottom of the cart 80 has two pairs of wheels 82 and 84 which roll on the bottom of the box 36. The top of the cart 80 also has a pair of wheels 86 which roll on a ramp 88 on the underside of the lid 48. When the cart 80 is in its rearwardmost position (as shown in FIG. 4) the lid 48 of the box 36 slopes slightly rearwardly so that the seat 52 slopes rearwardly. When the cart 80 is in its forwardmost position (as shown in FIG. 5) the lid 48 of the box 36 slopes generally forwardly, so that the seat 52 slopes forwardly. Because the seat back 26 is mounted on back strap 62, which is mounted on lid 48 by bracket 60, the pivoting of the lid 48 causes the back to tilt in unison with the seat. The actuator 66*a* is controlled by a control button on a control panel, as described below, to operate in the forward or reverse directions to change the angle of tilt of the seat 52 (and back 26**).

Figure 6:
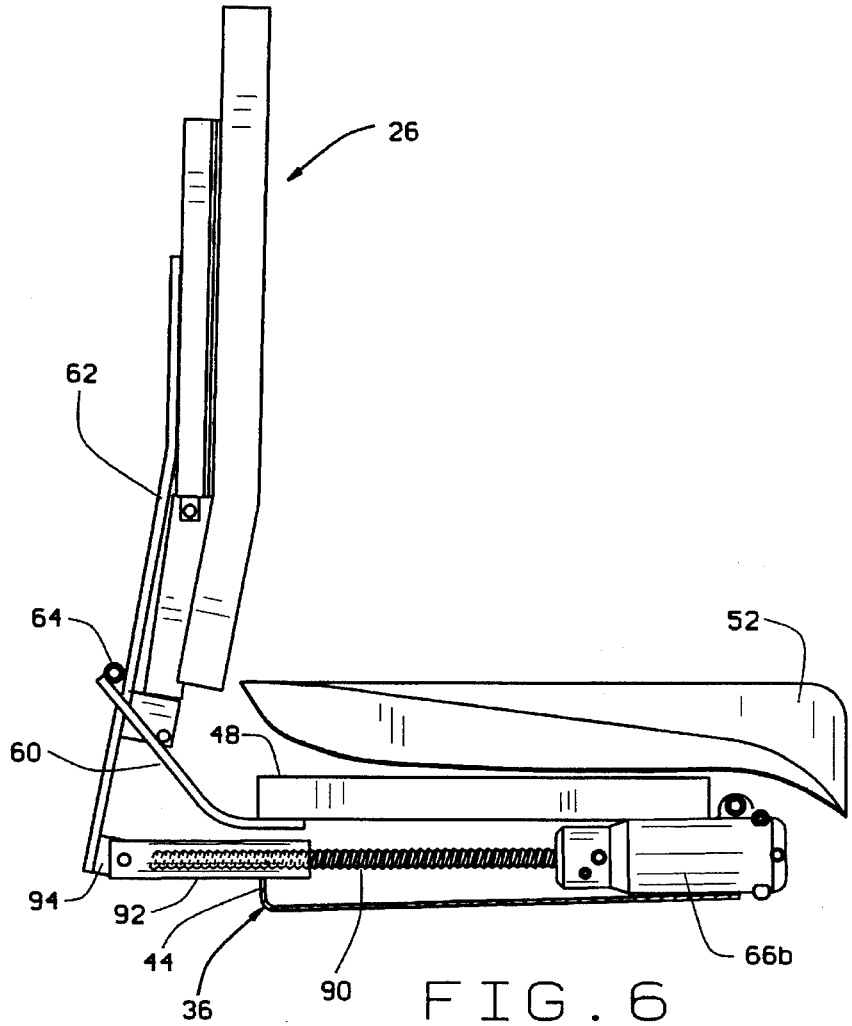
FIG. 6 is a partial vertical cross-sectional view of the task chair, taken along the plane of line 6—6 in FIG. 3, showing the back tilt adjustment mechanism, with the back in its forwardmost tilted position.
Figure 7:
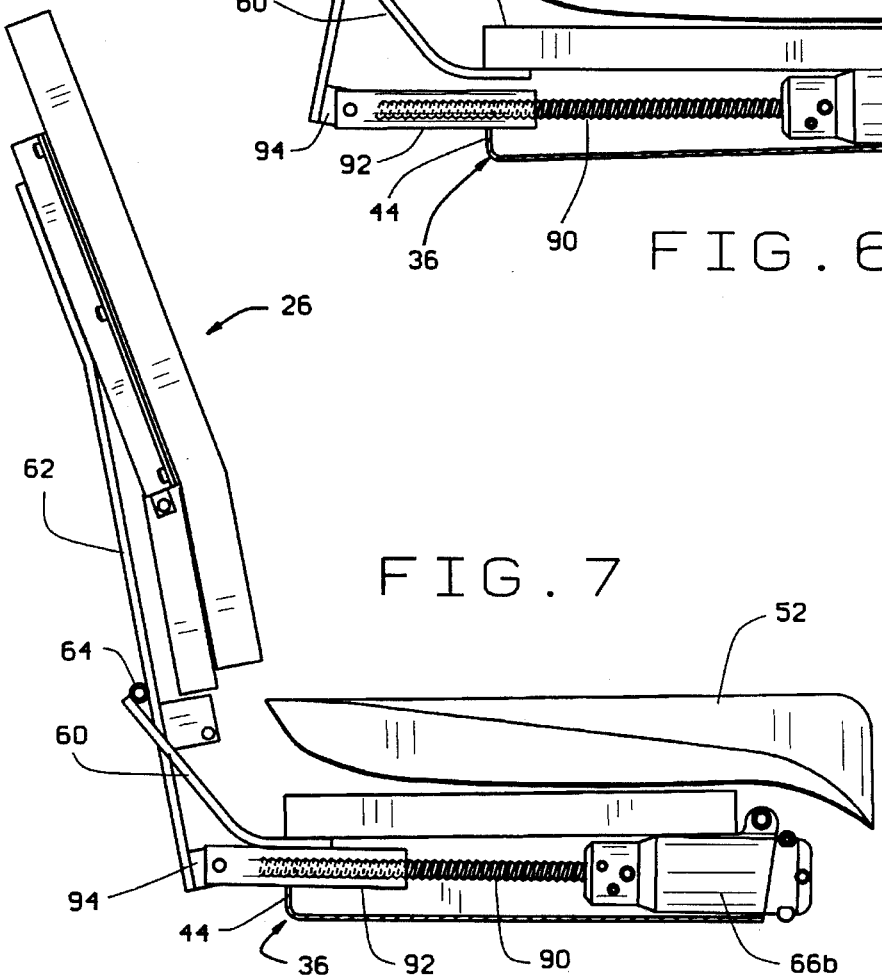
FIG. 7 is a partial vertical cross-sectional view of the task chair, similar to FIG. 6, except that the back is in its rearwardmost tilted position.

The back tilt adjustment mechanism is best shown in FIGS. 6 and 7. The back tilt adjustment mechanism comprises an actuator **66*b* inside the box 36, having a screw 90 on the drive shaft of the actuator. The front end of the actuator is pivotally mounted at the front of the lid 48, so that the actuator can pivot as the back 26 tilts (compare FIG. 7, where the back is tilted rearwardly, with FIG. 6, where the back is tilted forwardly). The screw 90 extends rearwardly from the actuator 66*b*, through an opening in the back 44 of the box 36. The rearward end of the screw is threaded into an internally threaded receiver 92. The rearward end of the receiver 92 is pivotally connected to a tab 94 projecting from the forward surface of the mounting strap 62, at a point below the hinge 64. Rotation of the screw 90 drives the screw into and out of the receiver 92. As the screw 90 threads into the receiver 92, the screw pulls the lower end of the mounting strap 62 forwardly, causing the seat back 26 mounted thereon to pivot about the hinge 64, and tilt rearwardly. FIG. 7 shows the screw 90 in its innermost position with respect to receiver 92. As the screw 90 threads out of the receiver 92, the screw pushes the lower end of the mounting strap 62 rearwardly, causing the back to pivot about the hinge 64, and tilt forwardly. FIG. 6 shows the screw 90 in its outermost position with respect to receiver 92. The actuator 66*b* is controlled by a control button on a control panel, as described below, to operate in the forward or reverse direction, to change the angle of tilt of the back 26**.

Figure 8:
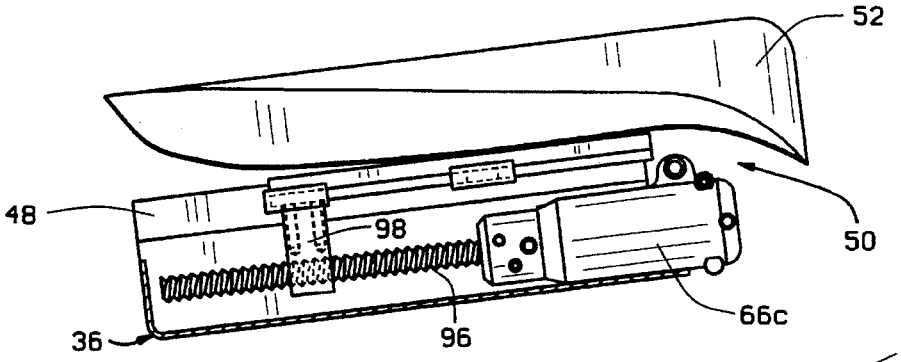
FIG. 8 is a partial vertical cross-sectional view of the task chair, taken along the plane of line 8—8 in FIG. 3, showing the seat depth adjustment mechanism, with the seat in its rearwardmost position.
Figure 9:
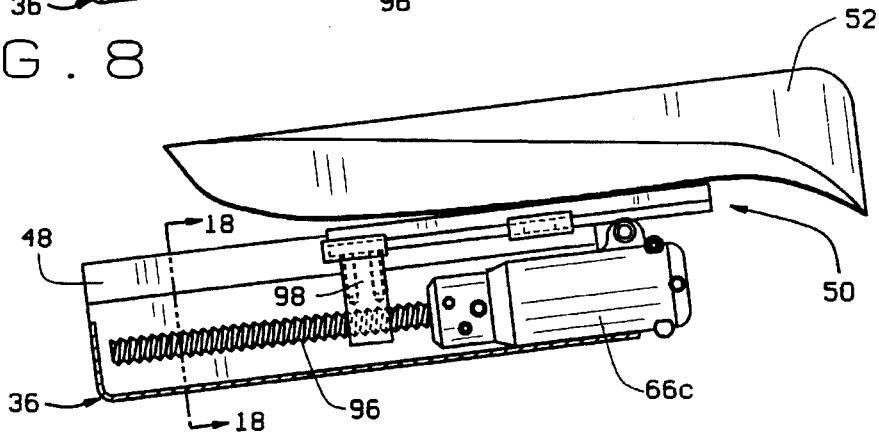
FIG. 9 is a partial vertical cross sectional view of the task chair, similar to FIG. 8, except that the seat is in its forwardmost position.

The seat depth adjustment mechanism is best shown in FIGS. 8, 9 and 18. The seat depth adjustment mechanism comprises an actuator **66*c* mounted on the lid 48 of the box 36, and having a screw 96 on the drive shaft of the actuator. The actuator 66*c* is mounted on the lid so that it moves with the seat 52 as the lid 48 tilts the seat. The screw 96 extends rearwardly from the actuator. A tab 98 is threaded on screw 96, such that rotation of the screw 96 causes the tab to move forwardly and rearwardly relative to the lid 48, depending upon the direction of rotation. The top of the tab 98 extends through a slot 100 in the lid 48, and is connected to the seat 52, via the support 51. (See FIG. 18) The movement of the tab 98 causes the seat 52 to slide on the tracks 50. The travel of the tab 98 on the screw 96 can be limited by the length and position of the slot 100 in the top 48. When the tab 98 is at its rearwardmost position with respect to the screw 96, as shown in FIG. 8, the seat 52 is at its rearwardmost position. When the tab 98 is at its forwardmost position with respect to the screw 96, as shown in FIG. 9, the seat 52 is in its forwardmost position. The actuator 66*c* is controlled by a control button on a control panel, as described below, to operate in the forward or reverse directions to move the seat 52 forwardly or rearwardly to adjust the depth of the seat 52 relative to the back 26**.

Figure 10:
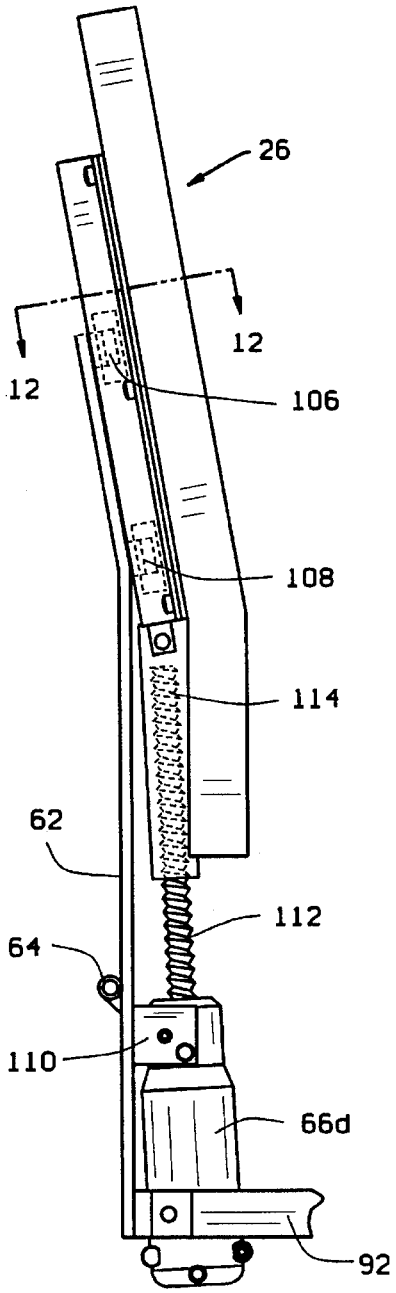
FIG. 10 is a partial side elevation view of the chair back, showing the back height adjustment mechanism, with the chair back in its highest position.
Figure 11:
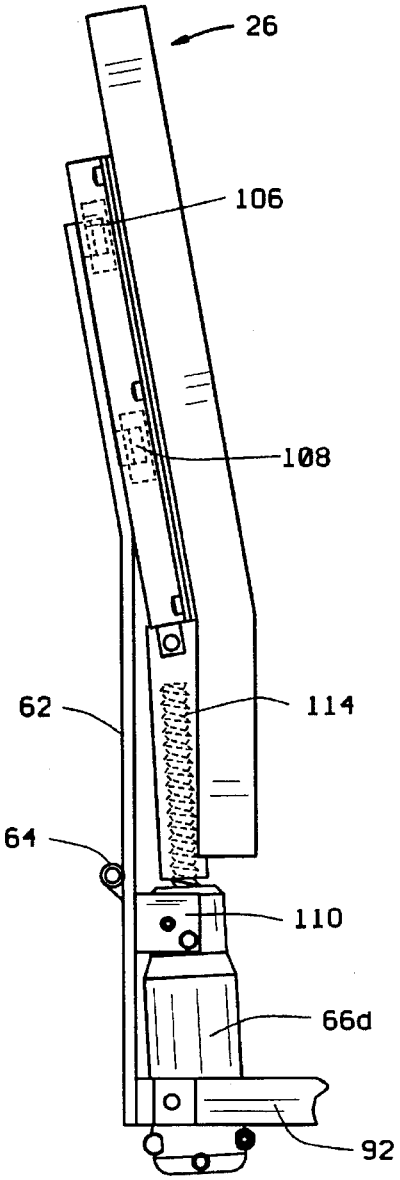
FIG. 11 is a partial side elevation view of the chair back, similar to FIG. 10, except that the chair back is in its lowest position.
Figure 12:
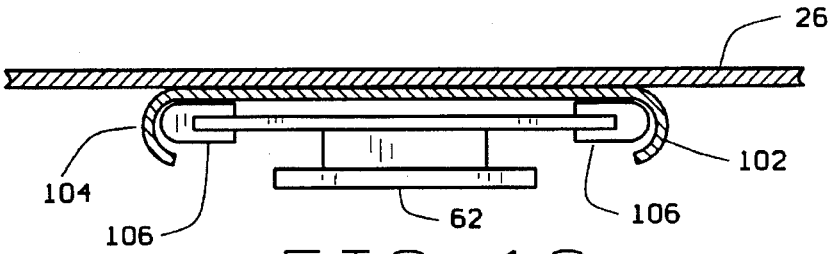
FIG. 12 is a horizontal cross-sectional view of the chair back, taken along the plane of line 12—12 in FIG. 10.

The back height adjustment mechanism is best shown in FIGS. 10 and 11. The back 26 is slidably mounted on the back support strap 62. The back 26 has a pair of vertically extending, opposed U-shaped tracks 102 and 104 on the rear surface thereof. Two pairs of sliders 106 and 108 extend laterally from the support strap 62, and engage the tracks 102 and 104, so that the chair back 26 can slide upwardly and downwardly with respect to the support strap. See FIG. 12. There is a U-shaped bracket 110 mounted on the front of support strap 62. The end of an actuator **66*d* is pivotally mounted between the legs of the U-shaped bracket 110. A screw 112 is on the drive shaft of the actuator 66*d*. The screw 112 extends generally vertically upwardly and the end is received in an internally threaded receiver 114, which is pivotally connected to a rear surface of the seat back 26. Rotation of the screw 112 threads the screw into and out of the receiver 114. As the screw 112 threads into the receiver 114, the screw pulls the chair back 26 downwardly. The chair back is shown in its lowest position in FIG. 11, with the screw 112 at its innermost position with respect to the receiver 114. As the screw 112 threads out of the receiver, the screw pushes the chair back upwardly. The chair back is shown in its highest position in FIG. 10, with the screw 112 at its outermost position with respect to the receiver 114. The actuator 66*d* is controlled by a control button on a control panel, as described below, to operate on the forward or reverse directions to raise and lower the back 26**.

Alternate embodiments of the seat height adjustment mechanism are shown in FIGS. 13–16. A first embodiment of the height adjustment mechanism is indicated generally as 120 in FIG. 13. Generally, the height adjustment mechanism of the present invention comprise an upper enclosure member and a lower enclosure member, one telescoping within the other, and a drive mechanism for moving the upper and lower enclosure members with respect to each other. In the first embodiment, the upper enclosure member comprises a generally rectangular gear cover 122, open at the bottom, with an actuator **66*e* extending generally horizontally from the gear cover 122. A nipple 126 is mounted on top of the gear cover 122, and is secured thereto, for example by snap fitting. The upper end of the nipple 126 has a taper and is adapted to be received in the socket of the mounting fixture 46 on the underside of the seat assembly 24. The upper enclosure member also includes a hollow shaft 128 depending downwardly from within the gear cover 122. The upper end of the hollow shaft 128 is rotatably mounted inside the nipple 126 with thrust bearing 130. The upper end of the hollow shaft 128 has a portion 132 of reduced diameter, defined by a shoulder 134**.

The lower enclosure member comprises a tube 136 for telescopingly receiving the hollow shaft 128. There is a cylindrical bushing 138 inside the upper portion of the tube 136 for slidingly supporting the hollow shaft 128 in the tube. A collar 140 is mounted on the tube 138, and secured, for example, with welds. The external surface of the collar 140 is tapered to fit in the mounting fixture 32 on the chair base 22.

In this first embodiment, the drive mechanism comprises an internally threaded receiver 142 formed or attached in the lower end of the hollow shaft 128, and an externally threaded screw 144 extending axially inside the tube 136. The lower end of the screw 144 is secured in an opening 146 in the center of a circular plate 148 at the bottom of the tube 138, for example by press-fitting, keying, welding, or other suitable means, so that the screw does not turn relative to the tube 136. A washer 150 is secured on the upper end of the screw 144 with a fastener 152, forming a shoulder 154. The washer 150 is installed on the end of the screw 144 through an axial passage through the top of the hollow shaft 128.

There is a bevel gear 156 on the drive shaft of the actuator **66*e*. The bevel gear 154 meshes with a bevel gear 158 on the hollow shaft 128, so that the actuator 66e rotates the shaft. The bevel gear 158 is secured on a shoulder (not shown) on the hollow shaft 128 with a roll pin 160. The bevel gear 158 engages the thrust bearing 130. The rotation of the hollow shaft 128 relative to the fixed screw 144 causes the hollow shaft to translate vertically upwardly and downwardly, depending upon the direction of rotation of the cylinder, thereby raising and lowering the seat 52 relative to the base 22. The actuator 66*e* is controlled by a control button on a control panel, as described below, to raise and lower the seat. The downward movement of the seat is stopped when the hollow shaft 128 is at the bottom of its travel, and the bottom surface of the threaded retainer 142 abuts the plate 148. The upward movement of the seat is stopped when the hollow shaft 128 is at the top of its travel, and the top surface of the threaded retainer 142 abuts the shoulder 154 formed by the washer 150**.

Figure 14:
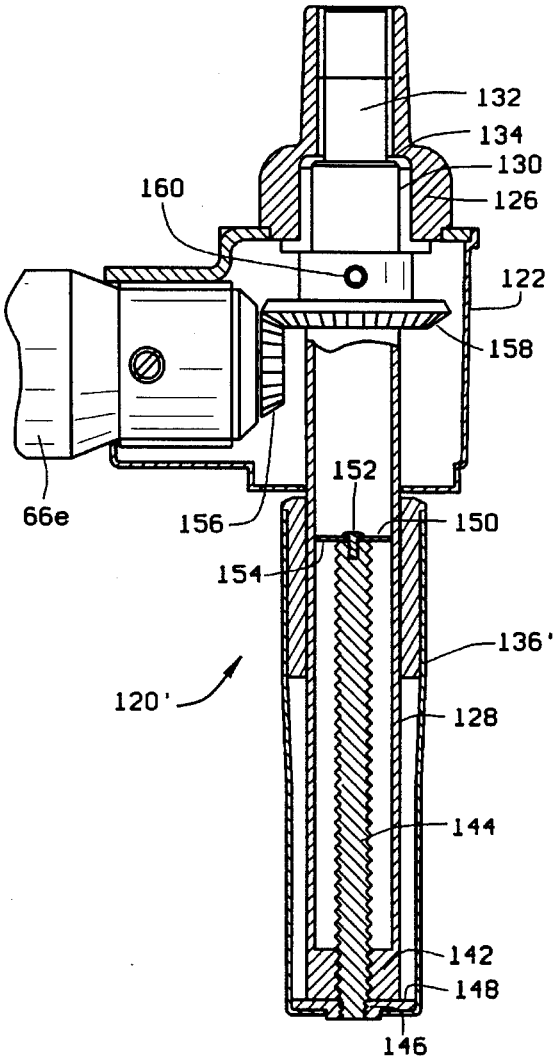
FIG. 14 is a vertical cross-sectional view of an alternate construction of the first embodiment of a chair height adjustment mechanism constructed according to the principles of this invention.
Figure 13:
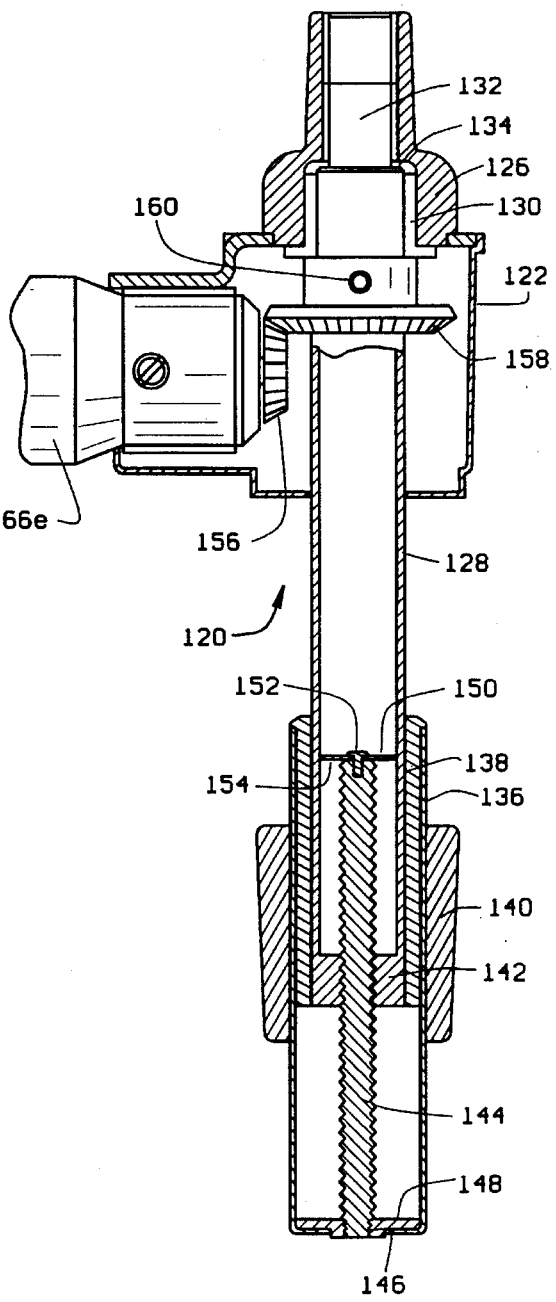
FIG. 13 is a vertical cross sectional view of a first embodiment of a chair height adjustment mechanism constructed according to the principles of this invention.

An alternative construction of the first embodiment of the electrically-powered height adjustment mechanism is indicated generally as 120' in FIG. 14. The module 120' is similar in construction to module 120, and corresponding parts are identified with corresponding numerals. The difference between modules 120 and 120' is that the module 120' does not have a collar 140, and instead has a tube 136' with a taper formed therein. As shown in FIG. 14, the module 120' is in its retracted position, in which the seat 52 is supported at its lowest position, while in FIG. 13, the module 100 is shown intermediate its retracted and extended positions.

Figure 15:
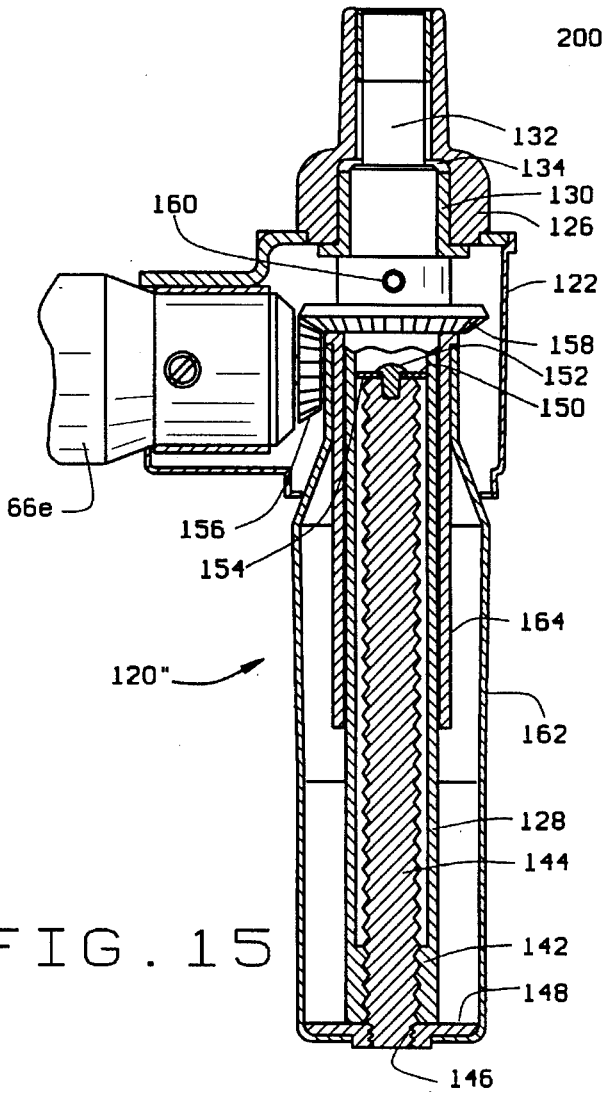
FIG. 15 is a vertical cross-sectional view of a second alternate construction of a chair height adjustment mechanism constructed according to the principles of this invention.

A second alternative construction of the first embodiment of the electrically-powered height adjustment mechanism is indicated generally as 120" in FIG. 15. The module 120' is similar in construction to module 120, and corresponding parts are identified with corresponding numerals. However, instead of tube 136, module 120" has a larger canister 162, with a bushing 164 therein.

Otherwise operation of the module 120" is similar to the operation of modules 120 and 120'.

Figure 16:
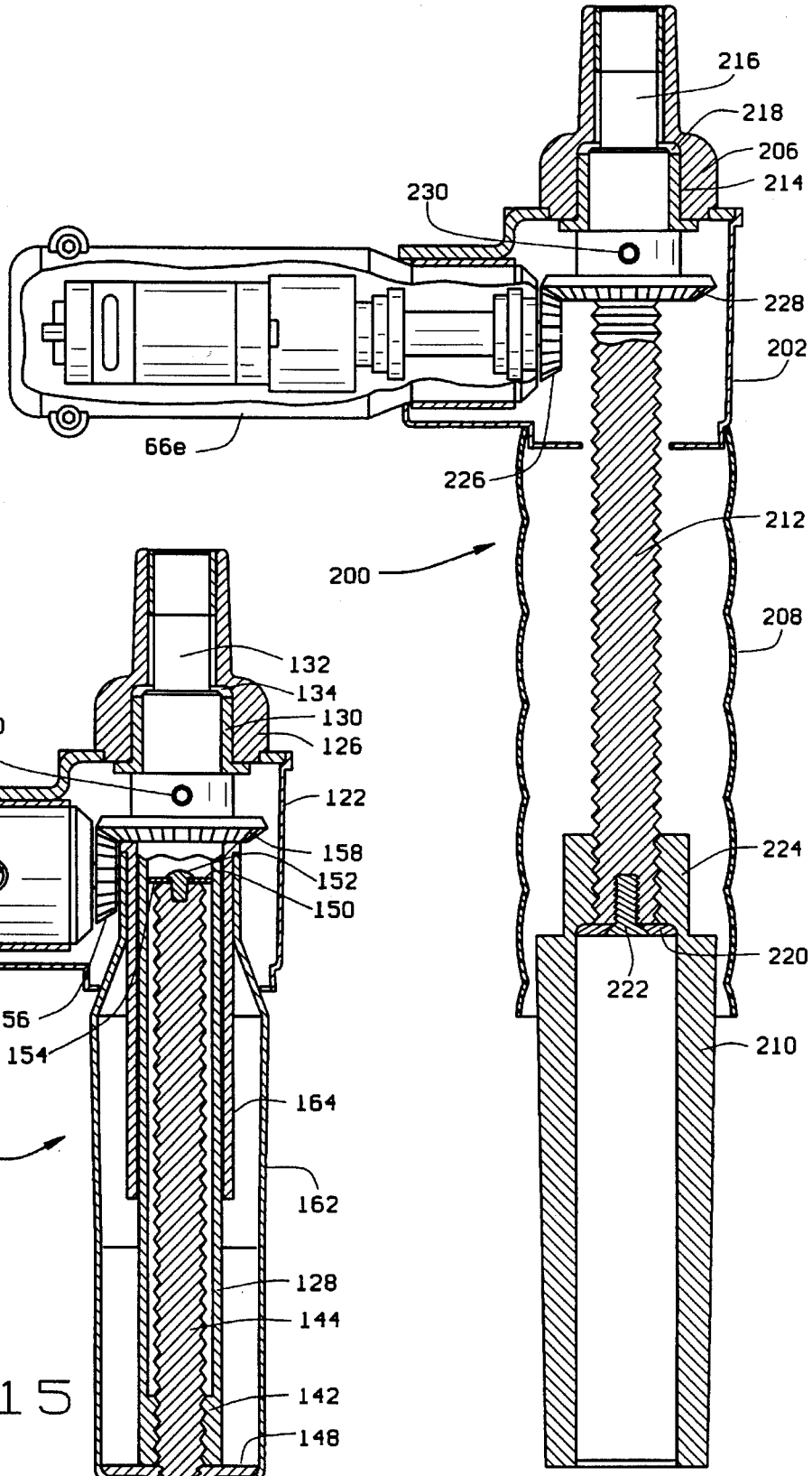
FIG. 16 is a vertical cross-sectional view of a second embodiment of a chair height adjustment module constructed according to the principles of this invention.

A second embodiment of an electrically powered height adjustment mechanism is indicated generally as 200 in FIG. 16. In this second embodiment the upper enclosure member comprises a generally rectangular gear cover 202, open at the bottom, with an actuator **66*e* extending horizontally from the gear cover 202. A nipple 206 is mounted on top of the gear cover 202, and may be secured thereto, for example by snap fitting. The upper end of the nipple 206 has a taper and is adapted to be received in a mounting fixture 46 on the underside of the chair seat assembly 24. The upper enclosure member also includes a flexible boot 208 depending downwardly from the underside of the gear cover 202**.

The lower enclosure member comprises a tube 210 that telescopes into the boot 208. The exterior of the tube 210 is preferably tapered to fit in the mounting fixture 32 on the chair base 22.

In this second embodiment, the drive mechanism comprises an externally threaded screw 212 depending downwardly from the gear box 202. The upper end of the screw 212 is rotatably mounted inside the nipple 206 with thrust bearing 214. The upper end of the screw 212 has a portion 216 of reduced diameter, defined by a shoulder 218. There is a washer 220 secured on the lower end of the screw 212 with a fastener 222. The drive mechanism also comprises an internally threaded receiver 224, which is preferably formed integrally with the tube 210. The threaded receiver 224 receives the screw 212.

There is a bevel gear 226 mounted on the drive shaft of the actuator **66*e*. The bevel gear 226 meshes with a bevel gear 228 on the screw 212, so that the actuator 66*e* turns the screw. The bevel gear 228 can be secured to the screw 212, with, for example, a roll pin 230**.

The rotation of the screw 212 relative to the fixed receiver 224 causes the screw to translate vertically upwardly and downwardly, depending upon the direction of rotation, thereby raising and lowering the seat 52 of the chair relative to the base 22. The actuator **66*e* is controlled by a control button on a control panel, as described below, to raise and lower the seat 52. The downward travel of the seat 52 is stopped when the screw 212 is at the bottom of its travel, and the top surface of the receiver 224 abuts the bottom surface of the bevel gear 228. The upward travel of the seat 52 is stopped when the screw is at the top of its travel, and the washer 220 abuts the bottom surface of the receiver 224, as shown in FIG. 16**.

Figure 17:
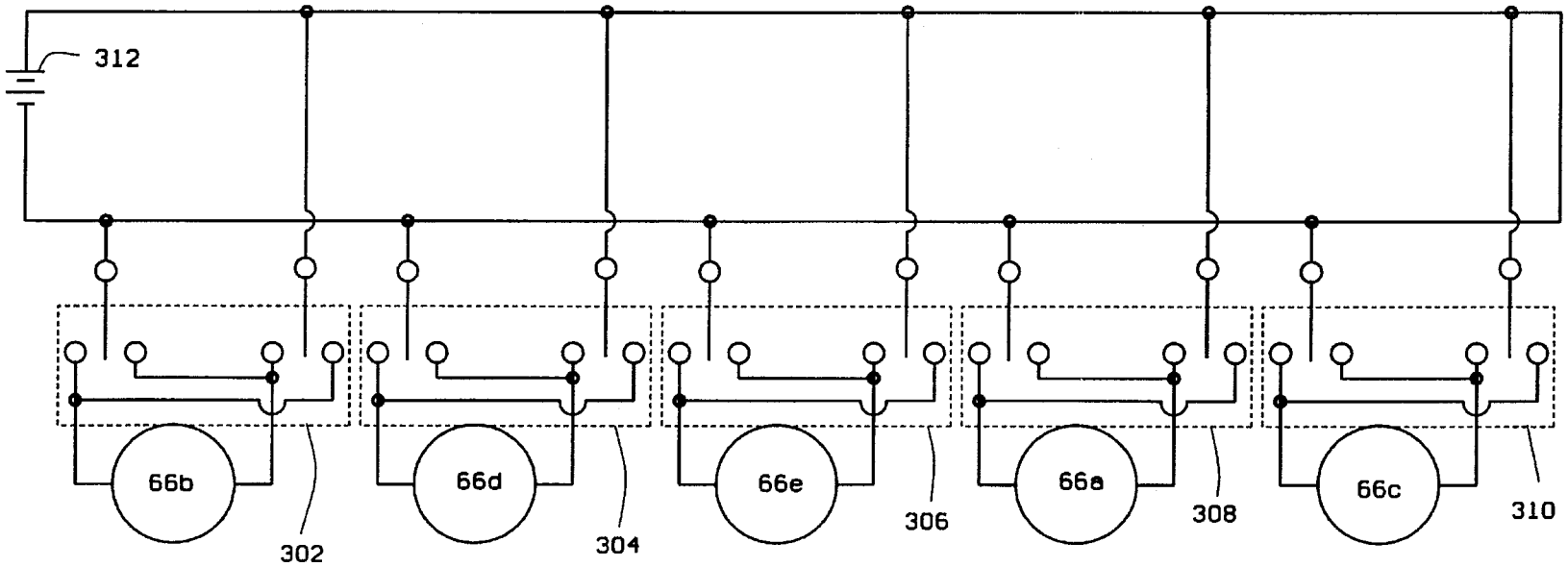
FIG. 17 is a schematic wiring diagram, showing the connection of the control switches to the actuators.

The chair 20 further comprises a control panel 300, having five buttons 302, 304, 306, 308, and 310 for controlling actuators **66*b*, 66*d*, 66*e*, 66*a*, and 66*c*, respectively. As shown in FIG. 17, each of the switches 302, 304, 306, 308, and 310 is a double pole, double throw, momentary switch, that can operate its respective actuator in either the forward or reverse direction. The circuit also includes rechargeable nickel-cadmium batteries 312 that can be conveniently removed from the circuit and recharged. The control panel depending on the number of actuators employed, will require one switch for each actuator. The switches 302, 304, 306, 308, and 310** are preferably oriented so that their function and operation are intuitive.

OPERATION

Seat Tilt

In operation, switch 308 is operated to operate the actuator **66*a*, which causes screw 78 to rotate. The rotation of the screw 78 moves the cart 80 forward or backward in the box 36, depending upon the direction of rotation of the screw as determined by the switch 308. As the cart 80 moves forward, the wheels 86 engage the ramp 88 on the lid 48, pushing upwardly and causing the lid to tilt forwardly, thereby tilting the seat 52 forwardly. As the cart 80 moves rearwardly, the wheels 86 allow the lid to drop, causing the lid to tilt rearwardly, thereby tilting the seat 52** rearwardly.

Back Tilt

Switch 302 is operated to operate actuator **66*b*, which causes screw 90 to rotate. The rotation of the screw 90 causes the screw to travel into or out of the receiver 92, depending upon the direction of rotation of the screw as determined by the switch 302. As the screw 90 threads into the receiver 92, the screw pulls the receiver forwardly, causing the back support strap 62 to pivot about the hinge 64, and tilt rearwardly. As the screw 90 threads out of the receiver 92, the screw pushes the receiver rearwardly, causing the back support strap 62 to pivot about the hinge 64** and tilt forwardly.

Seat Depth

Switch 310 is operated to operate actuator **66*c*, which causes the screw 96 to rotate. The rotation of the screw 96 causes the tab 98 to move forwardly or rearwardly in the slot 100 in the lid 48, depending upon the direction of rotation of the screw as determined by the switch 310. As the tab 98 moves forwardly, it moves seat 52, which is slidably mounted on tracks 50, forwardly. Similarly, as the tab 98 moves rearwardly, it moves seat 52, which is slidably mounted on the tracks 50**, rearwardly.

Back (Lumbar) Height

Switch 304 is operated to operate actuator **66*d*, which causes screw 112 to rotate. The rotation of the screw 112 causes the screw to travel into or out of the receiver 114, depending upon the direction of rotation of the screw as determined by the switch 304. As the screw 112 threads into the receiver 114, the screw pulls the receiver downwardly, pulling the chair back 26, which is slidably mounted on the strap 62 downwardly. As the screw 112 threads out of the receiver 114, the screw pushes the receiver upwardly, pushing the seat back 26, which is slidably mounted on the strap 62**, upwardly.

Seat Height

Switch 306 is operated to operate the actuator **66*e*. In the first embodiment, the actuator 66*e* turns the bevel gear 156 causing meshing bevel gear 158 to turn, which causes the shaft 128 to turn. The turning of the shaft 128, and in particular threaded receiver 142 thereon, relative to the screw 144 causes the cylinder to translate vertically upwardly and downwardly, depending on the direction of rotation determined by the switch 306. When the module reaches its most extended position, the shoulder 154 formed by the washer 150 engages the top of the threaded receiver 143, stopping further relative vertical motion. When the module reaches its most retracted position, the bottom of the receiver 142 abuts the plate 148**, stopping further relative vertical motion.

In the second embodiment, the actuator **66*e* turns bevel gear 226, which causes meshing bevel gear 228 to turn, which causes the screw 212 to turn. The turning of the screw 212 relative to the tube 210 and in particular relative to the threaded receiver 224 thereon, causes the screw to translate vertically upwardly and downwardly. When the module reaches its most extended position, the shoulder formed by the washer 220 engages the bottom the threaded receiver 224, stopping further relative vertical motion. When the module reaches its most retracted position, the top of the receiver 224 abuts the bevel gear 228**, stopping further relative vertical motion.

Thus, the adjustment mechanisms of the present invention allow the user of the chair to quickly and easily adjust the position of the chair to the appropriate position, without ever leaving the chair. The adjustment mechanisms also make it easy to frequently readjust the position of the chair, so that the user does not remain in the exact same position for extended periods of time.

What is claimed:

1. A cordless, power-adjustable office or task chair comprising:

a chair base;

an adjustable column supported on the chair base, comprising telescoping upper and lower members;

a bottom plate mounted on the adjustable column;

a top plate hingedly mounted to the bottom plate generally at the front of the chair for tilting forwardly and rearwardly with respect to the bottom plate;

a seat slidably mounted on the top plate for sliding movement in the forward and rearward directions with respect to the top plate;

a bracket extending rearwardly and upwardly from the top plate, and a back support strap hingedly mounted to the bracket for pivoting forwardly and rearwardly about a generally horizontal axis, and a chair back slidably mounted on the support strap for axial movement with respect to the support strap;

a seat height adjustment mechanism, including an electric motor, for moving the upper and lower members of the adjustable column relative to each other to raise and lower the height of the seat;

a seat tilt adjustment mechanism, including an electric motor, for moving the top plate relative to the bottom plate to adjust the angle of tilt of the seat;

a seat position adjustment mechanism, including an electric motor, for moving the seat relative to the top plate;

a back tilt adjustment mechanism, including an electric motor, for moving the back support strap to tilt the chair back forwardly and rearwardly;

a back height adjustment mechanism, including an electric motor, for moving the back axially with respect to the back support strap; and a seat height switch for controlling the seat height adjustment mechanism, a seat tilt switch for controlling the seat tilt adjustment mechanism, a seat position switch for controlling the seat position adjustment mechanism, a back tilt switch for controlling the back tilt adjustment mechanism; and a back height switch for controlling the back height adjustment mechanism, each of the switches being positioned so as to be operable by a user seated on the chair.

2. The cordless, power-adjustable office or task chair of claim 1 wherein the seat tilt adjustment mechanism includes a threaded screw turned by the electric motor, which extends between the top and bottom plates and a cart threaded on the rod to translate relative to the rod as the rod turns, the movement of the cart along the rod causing relative pivotal movement of the plates at the hinged mounting, thereby tilting the seat mounted on the top plate forwardly and rearwardly.

3. The cordless, power-adjustable office or task chair of claim 1 wherein the back tilt adjustment mechanism comprises a threaded rod turned by the electric motor, and a threaded receiver pivotally connected to the support strap on the opposite side of the hinged mounting from the back, in threaded engagement with the screw so that turning of the screw into the receiver pulls the strap, and turning of the screw out of the receiver pushes the strap, to tilt the back, mounted on the support strap.

4. The cordless, power-adjustable office or task chair of claim 1 wherein the back height adjustment mechanism comprises a threaded rod turned by the electric motor, and a threaded receiver connected to the back, in threaded engagement with the rod so that turning of the rod into the receiver pulls the back and turning of the rod out of the receiver pushes the back, to move the back downwardly and upwardly on the support strap.

5. The cordless, power-adjustable office or task chair of claim 1 wherein the seat position adjustment mechanism comprises a threaded rod turned by the electric motor, and a tab threaded on the rod to translate relative to the rod as the rod turns, the tab connected to the seat so that movement of the tab as the rod turns slides the seat forwardly and rearwardly.

6. The cordless, power-adjustable office or task chair of claim 1 wherein the seat height adjustment mechanism comprises two drive elements: an externally threaded screw and an internally threaded screw receiver, one of the drive elements being fixedly mounted to one of the upper or lower members, and one of the drive elements being rotatably mounted to the other of the upper and lower members, and wherein the electric motor rotates the rotatably secured drive element to drive the fixedly secured drive element and thereby cause the upper and lower members to which the drive elements are secured to telescope with respect to each other raising or lowering the seat.

7. The cordless, power-adjustable office or task chair according to claim 6 wherein the lower member telescopes within the upper member.

8. The cordless, power-adjustable office or task chair according to claim 6 wherein the externally threaded screw is rotatably mounted to one of the upper or lower members.

9. The cordless, power-adjustable office or task chair according to claim 8 wherein the externally threaded screw is rotatably secured to the upper member.

10. The cordless, power-adjustable office or task chair according to claim 8 wherein the externally threaded screw is rotatably secured to the lower member.

11. A cordless, power-adjustable office or task chair comprising:

a chair base;

an adjustable column supported on the chair base;

a bottom plate mounted on the adjustable column;

a top plate hingedly mounted to the bottom plate, generally at the front of the chair so that the top plate can tilt forwardly and rearwardly with respect to the bottom plate;

a seat slidably mounted on the top plate for sliding movement in the forward and rearward directions relative to the top plate;

a seat position adjustment mechanism including an electric motor mounted on the top plate for movement therewith, a threaded rod turned by the electric motor, and a tab threaded on the rod to translate relative to the rod as the rod turns, the tab connected to the seat so that movement of the tab as the rod turns slides the seat forwardly and rearwardly;

a seat tilt adjustment mechanism including an electric motor that turns a threaded rod that extends between the top and bottom plates, a cart threaded on the rod to translate relative to the rod as the rod turns, the movement of the cart along the rod between the plates causing relative pivotal movement of the plates at the hinge, thereby tilting the seat mounted on the top plate forwardly and rearwardly;

a bracket extending rearwardly and upwardly from the top plate;

a back support strap hingedly mounted to the bracket intermediate the ends of the support strap for pivoting forwardly and rearwardly about a generally horizontal axis;

a chair back slidably mounted on the support strap for axial movement with respect to the support strap;

a back tilt adjustment mechanism comprising an electric motor, a threaded rod turned by the electric motor, and a threaded receiver pivotally connected to the support strap on the opposite side of the hinge from the back, to push or pull the support strap as the motor turns, for tilting the back support strap forwardly and rearwardly.

12. The cordless power-adjustable office or task chair according to claim 11, wherein the back is slidably mounted on the support strap for axial movement with respect to the support strap, and further comprising a back height adjustment mechanism including an electric motor, fixed relative to the support strap, that turns a threaded rod, and a threaded receiver connected to the back, in threaded engagement with the rod so that turning of the rod into the receiver pulls the back and turning of the rod out of the receiver pushes the back to move the back downwardly and upwardly on the support strap.

13. The cordless power adjustable office or task chair according to claim 11, wherein the adjustable column comprises telescoping upper and lower members, and two drive elements: an externally threaded screw and an internally threaded screw receiver, one of the drive elements being fixedly secured to one of the upper and lower members, and one of the drive elements being rotatably secured to the other of the upper and lower members, and wherein the electric motor rotates the rotatably secured drive element to drive the fixedly secured drive element and thereby cause the upper and lower members to which the drive elements are secured to telescope with respect to each other raising or lowering the seat.

* * * * *